US005331785A

United States Patent [19]

Brak

[11] Patent Number: 5,331,785

[45] Date of Patent: Jul. 26, 1994

[54] CLEAN ROOM CEILING

[75] Inventor: Johan W. Brak, Bergen Op Zoom, Netherlands

[73] Assignee: Hunter Douglas International N.V., Curacao, Netherlands Antilles

[21] Appl. No.: 967,923

[22] Filed: Oct. 28, 1992

Related U.S. Application Data

[63] Continuation of Ser. No. 472,510, Jan. 30, 1990, abandoned.

[30] Foreign Application Priority Data

Feb. 1, 1989 [DE] Fed. Rep. of Germany ..... 3902934
Sep. 29, 1989 [EP] European Pat. Off. ..... 89118117.4

[51] Int. Cl.[5] ..... E04B 9/00
[52] U.S. Cl. ..... 52/506.1; 52/506.06
[58] Field of Search ..... 52/484, 488, 489

[56] References Cited

U.S. PATENT DOCUMENTS

| | | | |
|---|---|---|---|
| 4,485,605 | 12/1984 | LaLonde | 52/484 X |
| 4,710,208 | 12/1987 | Ziemer et al. | 52/484 X |
| 4,769,958 | 9/1988 | Limp . | |
| 4,900,179 | 2/1990 | Kundert | 52/488 X |
| 4,991,370 | 2/1991 | Gailey et al. | 52/488 X |

FOREIGN PATENT DOCUMENTS

| | | | |
|---|---|---|---|
| 1536777 | 1/1970 | Fed. Rep. of Germany . | |
| 1951801 | 5/1970 | Fed. Rep. of Germany . | |
| 7143815 | 11/1971 | Fed. Rep. of Germany . | |
| 7318006 | 5/1973 | Fed. Rep. of Germany . | |
| 7332146 | 9/1973 | Fed. Rep. of Germany . | |
| 2408923 | 9/1975 | Fed. Rep. of Germany | 52/484 |
| 2858140 | 12/1979 | Fed. Rep. of Germany . | |
| 3020627 | 5/1980 | Fed. Rep. of Germany . | |
| 3500258 | 5/1985 | Fed. Rep. of Germany . | |
| 3635658 | 8/1987 | Fed. Rep. of Germany . | |
| 639720 | 8/1982 | Switzerland . | |
| 2153407 | 8/1985 | United Kingdom | 52/484 |

*Primary Examiner*—Carl D. Friedman
*Assistant Examiner*—Lan C. Mai
*Attorney, Agent, or Firm*—Pennie & Edmonds

[57] ABSTRACT

The invention relates to a sub-ceiling with a supporting framework in the form of a grid of insecting bearing rails (1), which is able to be suspended at points of intersection of the bearing rails (1), formed by the nodal elements (2), and the open regions (34) of which are able to be secured in an air-tight and dust-tight manner on the peripheral edges by insert members which may take the form of coffers, lighting elements, air-supply devices or air-outlet devices. The insert members rest in a sealing manner on a sealing means on the bearing rails (1), whereby in order to simplify manufacture, construction and assembly and to fulfill the requirements of clean-room conditions, the bearing rails (1) are attachable in an air-tight and dust-tight manner to the nodal elements (2), with the bearing rails (1) having angular supporting flanges (3) on their end walls (15) and the respective nodal element (2) has bearing surfaces (18) cooperating with the supporting flanges (3) to support the bearing rails (1).

20 Claims, 7 Drawing Sheets

CLEAN ROOM CEILING

This is a continuation of application Ser. No. 07/472,510, filed Jan. 30, 1990, now abandoned.

BACKGROUND OF THE INVENTION

1. Technical Field of the Invention

The invention relates to a ceiling structure and more particularly to a sub-ceiling with a supporting framework in the form of a grid of intersecting bearing rails which support suspended panels is in a sealed manner.

2. Description of Related Art

Such a sub-ceiling is known, for example, from DE 28 58 140 C2. Longitudinal or horizontal bearing rails with T-shaped cross-sections of aluminium are used as bearing rails in the ceiling disclosed in this application. The longitudinal and horizontal rails are connected to each other by means of a connecting element. The disadvantage in this method of construction is the expensive manufacture of the special profiles and the lack of adaptability to various constructional axis dimensions. In addition the assembly of the relatively long longitudinal bearing rails is problematic. The connecting joints between the longitudinal and horizontal bearing rails can easily develop leaks, which should be avoided in clean-rooms used for industrial manufacture of electric or electronic components.

SUMMARY OF THE INVENTION

The object of the present invention is the creation of a perfectly sealed sub-ceiling which has the advantages of a band screen cover in a nodal point system. This allows easy adaptability to different constructional axis dimensions, as well as fulfilling the requirements of clean-room conditions with simple fabrication from sheet metal sections and simple assembly. In this way a clean-room cover can be created which is also suitable for installing mobile separating walls.

This object is achieved according to the invention substantially in that bearing rails are able to be attached in an air-tight and dust-tight manner to the nodal elements, with the bearing rails having angular supporting flanges on end walls and the respective nodal element having bearing surfaces coordinated therewith. With this construction of the bearing rails and the nodal elements, a perfect seal is achieved by means of a with simple assembly of not only the panels on the bearing rails, but also in the whole nodal point region.

Sealing means are provided between the supporting flanges of the bearing rails and the bearing surfaces of the nodal elements. The sealing means are attachable in a simple manner to the corresponding bearing rail surfaces before assembly of the sub-cover. In this way leaks are avoided in the intermediate joint between the bearing rails, meeting at the nodal elements. The sealing means simultaneously fulfill three sealing functions: the bearing rails are sealed relative to the nodal element, the panels are sealed relative to the bearing rails and the bearing rails, meeting at a mitred point of intersection, are sealed against each other.

In order to achieve a connection between the bearing rails and nodal elements, supporting flanges of the bearing rails have slot-shaped recesses in which holding lugs of the nodal elements engage. This enables a simple and certain assembly of the bearing rails on the nodal elements in the correct position.

In a particularly advantageous design of the invention, each holding lug has a slot for accommodating a locking mechanism, whereby a simple, but ensured connection between the bearing rail and the nodal element is made possible.

The upper edge of the slot extends obliquely to the horizontal line and the locking mechanism is able to be locked in the horizontal line in the slot, creating a wedge effect between the locking mechanism and the slot. A clamping element provides the pressure necessary to create a gas-tight seal.

The clamping element has clamping edges angled downwards which act on the supporting flanges, preferably between the lugs of the bearing element and therefore directly on the lower side of the supporting flanges where the sealing band or the like extends, in order to produce a good sealing function. Such clamping elements can easily be made from sheet metal.

With the clean-room ceiling according to the invention the sealing occurs substantially in a horizontal plane. No sealing means is required in the vertical joints between the individual components, apart from the miter joints between the bearing rails in the region on the nodal point. In this way, disadvantageously wide and easily soiled joints between the individual panels or the like can be avoided. Since the bearing rails can be constructed of sheet metal with substantially vertical side walls and end walls, it is advantageous that the joints on an edge of the bearing rails are also able to be sealed in an air-tight and dust-tight manner. In this way the necessary clean-room conditions can be additionally served.

A further feature of the invention is seen in that the vertical side walls of the panels have on their upper ends supporting edges angled horizontally outwards, which preferably have reinforcement folds directed obliquely upwards at an angle of about 45° relative to the supporting edges. In this way, a reliable assembly and a simple means of holding the panels on the bearing rails is possible. The supporting edges of the panels extend preferably continuously all the way around.

Particularly with sub-ceilings of the type mentioned it is advantageous according to a further inventive idea if the supporting edges of the panels, in particular the oblique folds of the panels, are acted upon by pressure from a spring element with a clamping means. Pressure is applied in the direction of the respective supporting edge of the bearing rails carrying the sealing means, whereby the panels provide sealing relative to the bearing rails not only because of their own weight, but also, the spring element can guarantee a good sealing effect if there is a slight excess pressure in the clean-room. For a reliable assembly the spring elements can be inserted into the bearing rails preferably constructed as an upwardly open C-profile.

The spring element according to the invention which is also able to be inserted with sub-covers of a different construction has preferably a base section resting against the inner base of the bearing rail. Connected to the base are clamping portions which point obliquely upwards and outwards, and locking tongues which point obliquely upwards and inwards, which grip under the bilateral supporting edges of the bearing rails. In this way the spring element has a secure seat in the bearing rail in a simple design.

BRIEF DESCRIPTION OF THE DRAWING

Further aims, features, advantages and possibilities of use of the present invention are seen in the following description of an exemplary embodiment with the enclosed drawing, wherein.

FIG. *2b* is a partially broken away, exploded perspective view of a nodal element according to a further embodiment, with a partially broken away representation of a bearing rail, according to a further embodiment, before suspension on the nodal element;

FIGS. *3a–d* show a spring element according to the invention for fixing insert members or the like on bearing rails in coordination with sub-ceiling elements, wherein:

FIG. *3a* is an oblique view of the spring element alone,

FIG. *3b* is a front sectional view of the spring element in place on a bearing rail, FIG. *3c* is a top view of the spring element in FIG. *3b*, and FIG. *3d* is a side view through line A—A of FIG. *3b;*

FIGS. *4a–c* show a spring element according to a further embodiment for fixing insert members or the like to bearing rails in coordination with the sub-ceiling elements, wherein:

FIG. *4a* is a side view of the spring element,

FIG. *4b* is a top view of the spring element, and

Figure 5:
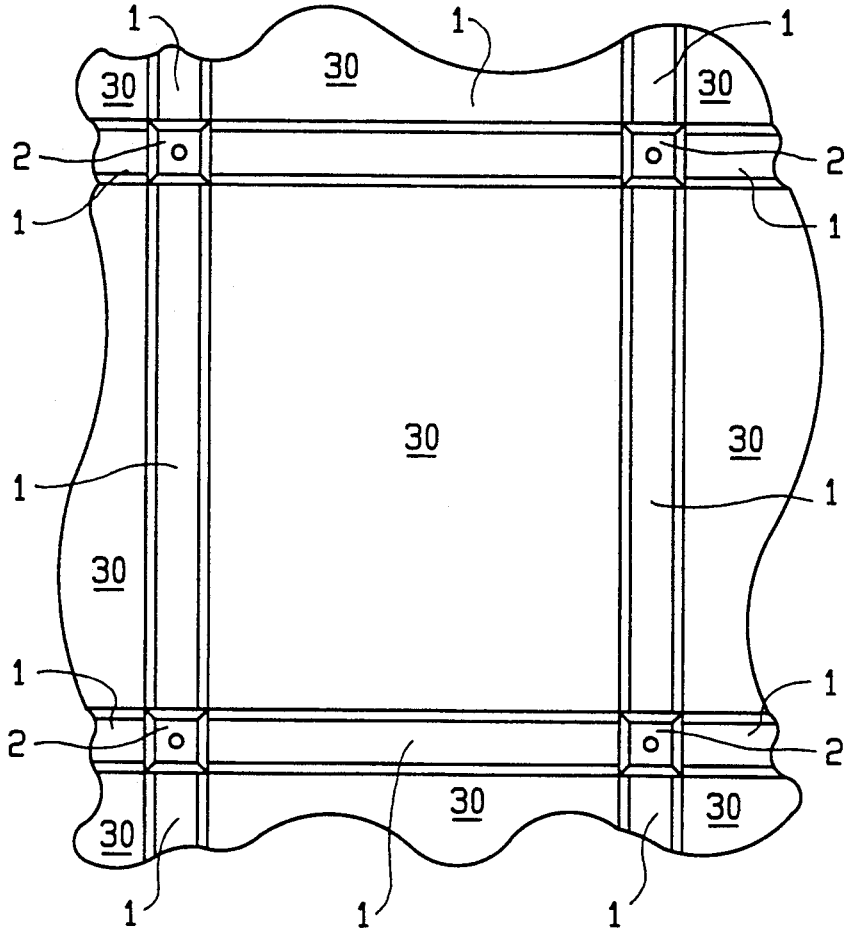
Figure 6:
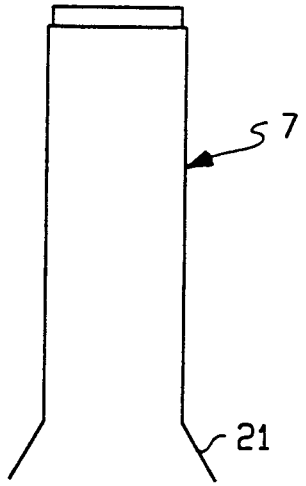

FIG. *4c* shows in a front partial sectional view of the spring element;

FIG. 5 is a schematic top plan view of a sub-ceiling according to the present invention;

FIG. 6 is a side elevational schematic view of the clamping element shown in FIG. *2b;*

Figure 7:
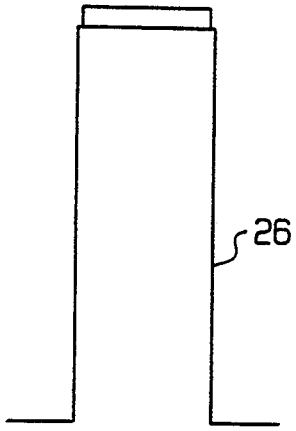

FIG. 7 is a side elevational schematic view of the fastening element shown in FIG. *2b;*

Figure 8:
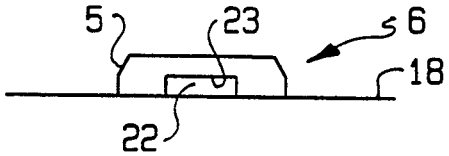
Figure 9:
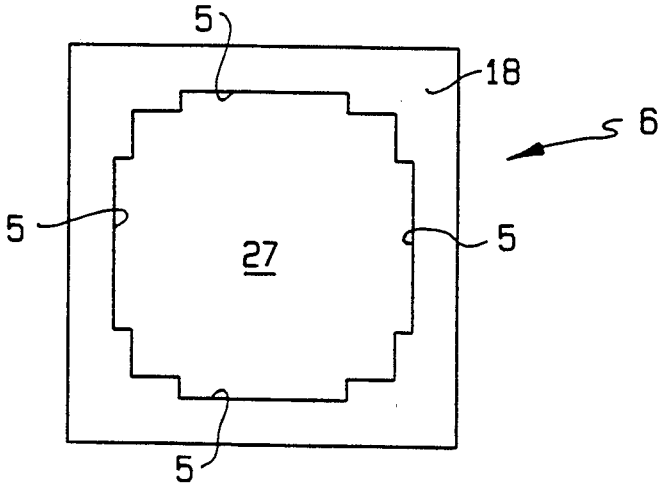

FIG. 8 is a side elevational schematic view of the bearing element shown in FIG. *2b;* and FIG. 9 is a top plan view of the bearing element shown in FIG. 8.

DESCRIPTION OF THE PREFERRED EMBODIMENTS

Referring first to FIG. 5, the general arrangement of a sub-ceiling according to the present invention illustrated. The supporting framework of the sub-ceiling is provided by a grid of intersecting bearing rails 1. The bearing rails 1 intersect a nodal elements 2 and are also suspended by nodal elements 2. The opening defined between intersecting bearing rails 1 is filled by insert members 30 to complete the sub-ceiling. As described below, the present invention includes two alternative embodiments of nodal element 2, shown in FIGS. *2a* and *2b*, respectively. As can be seen in FIGS. *2a* and *2b*, the bearing rails 1 used with each alternative embodiment of nodal elements 2 are substantially the same, except that frame shoe 38 is slightly differently shaped to accommodate the differences between the embodiments of nodal elements. Throughout the figures and description the same reference numerals are use to refer to the same parts.

Figure 1:
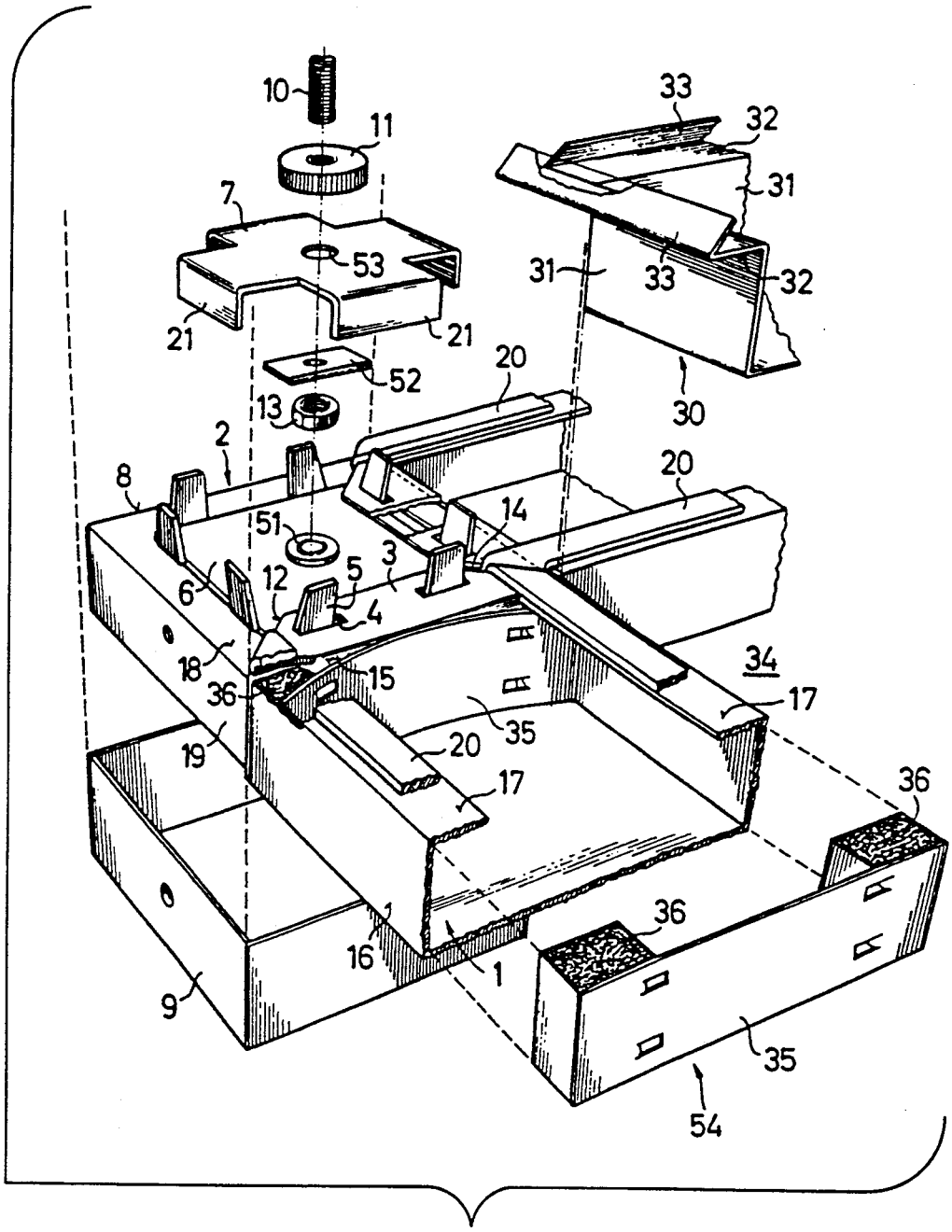
FIG. 1 is a partially broken away, exploded perspective view of a nodal element with two suspended bearing rails and an insert member before applying the bearing rails, FIG. *2a* is a partially broken away, exploded perspective view of the nodal element according to FIG. 1 with a partially broken away representation of a bearing rail, according to another embodiment, before suspending on the nodal element.

According to FIGS. 1, *2a* and *2b*, bearing rails 1 have in their end walls 15 supporting flanges 3 angled outwards in the longitudinal direction. The bearing rails 1 thus form a Z-profile on the end with the supporting flange 3. The supporting flanges 3 are provided with slot-shaped recesses 4, in which holding lugs 5 of the nodal elements 2 engage. In order to guarantee a simple fabrication of the bearing rails 1, they can be constructed, for example, as sheet metal sections which are folded or in rolled form, preferably coffer-shaped.

The bearing surface of the nodal element is part of a sealing body 8, which is constructed in a box shape with an inspection cover 9 able to be placed thereupon. In this way a perfect optical closure of the nodal elements is achieved with a good sealing function. The nodal elements 2 consist substantially of a bearing element 6, holding lugs 5 which are angled upwards, a box-type sealing body 8 which forms bearing surfaces 18 for the supporting flanges 3, and side walls 19 angled downwards, as well as inspection cover 9 which is mounted from below on the sealing body 8.

The bearing rails 1 are secured in the region of their supporting flanges 3 by means of a cross-shaped clamping element 7 forcing the flanges 3 in the direction of the bearing surfaces 18. The clamping element 7 has for this purpose clamping edges 21, angled downward, which engage between the holding lugs 5. The nodal element 2 is arranged so that it is vertically adjustable on a threaded rod 10, on which the bearing element 6 is screwed and secured with a nut 51. The setting of the height level of the nodal element 2 on the threaded rod 10 occurs by means of a counter nut 13.

The clamping force exerted by the clamping element 7 is accomplished by means of a milled tightening nut 11. Below the clamping element 7 there sits on the threaded rod 10 a sealing element 52. The sealing element 52 surrounds the threaded rod 10 in a sealing manner and thereby seals the passage opening 53 of the clamping element 7 for the threaded rod 10 in an airtight and dust-tight manner.

The end edges 12 of the supporting flanges 3 of the bearing rails 1 are provided with a miter 14. Supporting edges 17, angled inwardly, are located on the upper edges of the longitudinal side walls 16 of the bearing rails 1. A sealing band 20 extends in the longitudinal direction along the upper side of the supporting edges 17 and in the horizontal direction along the lower side of the supporting flanges 3. The sealing band 20 lies between the supporting flange 3 and the bearing surface 18 and, in one piece, leads through the joint between the miters 14. In the assembled state the sealing band 20 lies on the bearing surfaces 18 of the nodal elements 2, and biased by the clamping element 7, the sealing band 20 seals the bearing rails 1 against the nodal elements 2 in the horizontal plane.

The arrangement of the sealing band 20 is particularly effective and simple to construct if the supporting flanges 3 are cut to size with the mitre 14, which is adapted to the miter 14 of the supporting flanges 3 of the adjacent bearing rail 1. A 45° mitre is an advantage in the case of a square or rectangular nodal element. A 60° mitre results for example with a triangular nodal element. Other multi-cornered nodal point constructions are also inherently possible, whereby the mitre angle is correspondingly adapted.

In order to be able to achieve the best possible sealing in the miter region, the sealing band 20 is constructed preferably in one piece on each bearing rail 1 so that it extends over the miter cuts and thus sealing the miter 14. An expansion joint in the sealing band 20 lies below the supporting flange 3 of the bearing rail 1 where the flange 3 rests against the bearing surfaces 18 of the nodal element 2.

Figure 2A:
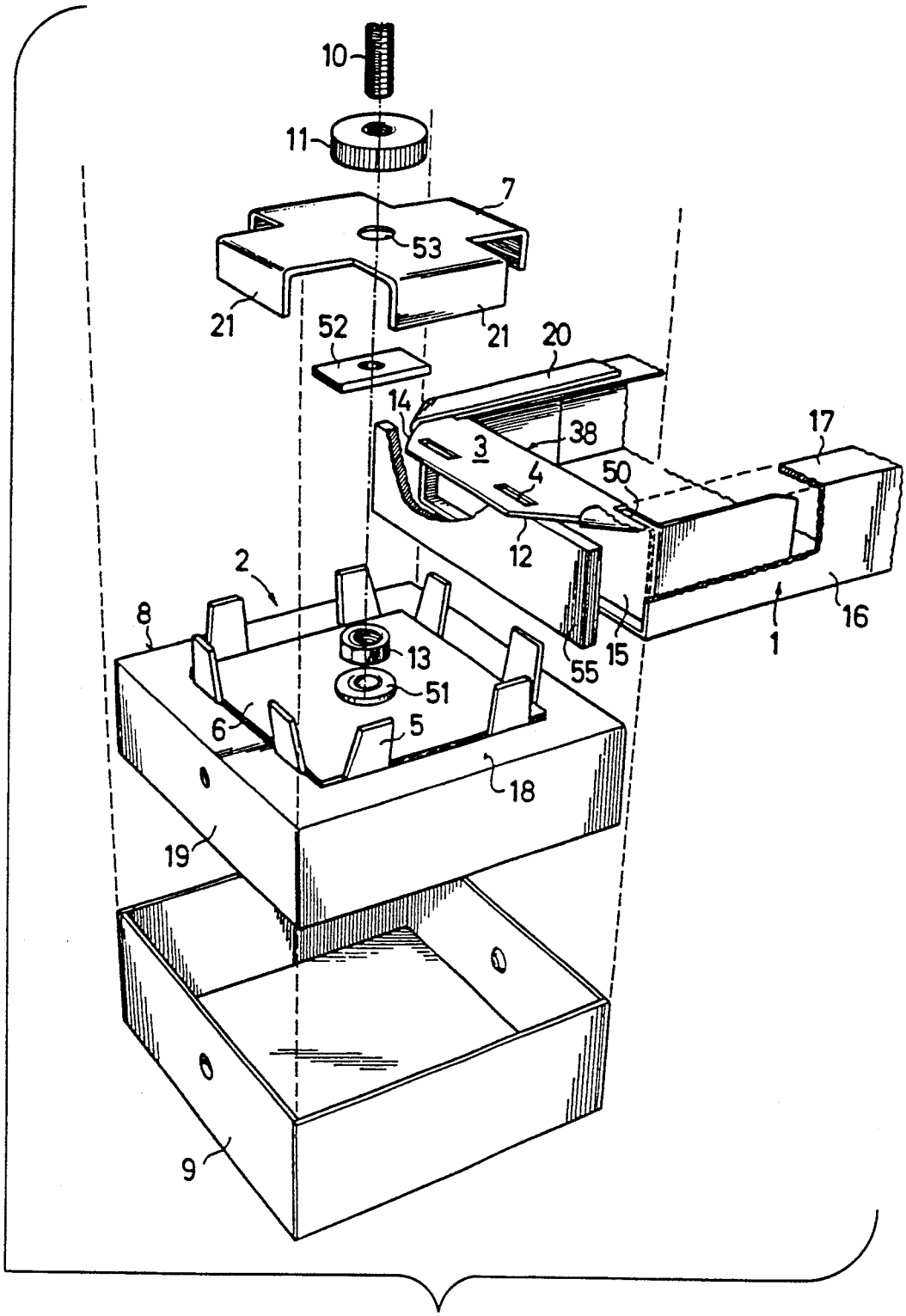

As can be seen from FIGS. 1 and 2*a*, the bearing element 6 projects by a predetermined material thickness over the bearing surfaces 18 of the sealing body 8. The supporting flanges 3 project to beyond the holding lugs 5 inwardly, and come to rest there on the bearing element 6, metal on metal. The sealing band 20 is provided only in the region of the bearing surfaces 18 and does not extend to the bearing element 6. In this way the bearing rails 1 are set at a defined height relative to the nodal element 2, so that on the one hand, the sealing band 20 is pressed together only a predetermined amount, while, on the other hand, the lower sides of the bearing rails 1 are aligned with the lower side of the inspection cover 9 which is mounted on the side walls 19 of the sealing body 8.

For sealing the joints on an edge, a cross-piece element 35 is provided between the end wall 15 and the longitudinal side walls 16 of the bearing rails 1. The cross-piece 35 consists of a spring-flexible material and on its edges a locking element 54 having in each case a sealing element 36. The cross-piece 35 is pushed inside, to the nodal-side end of the C-profiled bearing rail 1 so that the sealing elements 36 lock the said joints on an edge. The cross-piece element 35 of spring-flexible material is adjusted so that it is slightly bent when inserted into the interior of the bearing rail 1 and remains in this way in the sealing position in a firmly clamped manner. In this way longitudinal differences of the bearing rails in the assembled state are easily adjusted without the desired sealing function being degraded.

In the description and claims, insert members 30 is used as a simple descriptive term for any type of insert which could be used to fill the open regions 34 of the sub-ceiling. This includes solid, coffer-shaped panels, lighting elements, air supply devices, air outlet devices or other similar inserts. The only requirement for use with the present invention is that the insert device used is generally constructed as described herein for the insert members 30.

The insert members 30 have vertical side walls 31. On the upper end of the side walls 31 supporting edges 32 are attached and angled outwardly. The supporting edges 32 are provided with folds 33, which are inclined obliquely upwards and inwards from the outside edge of the supporting edges 32. The insert members 30 serve to cover the ceiling regions 34. They are clamped on the bearing rails 1 by means of spring elements 37, shown in FIGS. 3 or 4, whereby the supporting edges 32 lie in a sealed manner against the sealing bands 20 on the supporting edges 17 of the bearing rails 1. In order to fix the correct height level between insert members 30 and the bearing rails 1, the supporting edges 17 of the rails 1, or supporting edges 32 of the insert member 30, can be provided with small projections or dimples to ensure the desired spacing. In this way it can be ensured that the lower sides of the bearing rails 1 are aligned with those of the insert members 30.

In the embodiment represented in FIG. 2*a* the bearing rail 1 is cut off straight, at a fixed length at its head end facing the nodal element 2. A frame shoe 38 with a "Z"-fold forming the supporting flange 3 is tightly inserted into the nodal-side end and firmly position. The supporting flange 3 is angled on the end wall 15 of the frame shoe 38. In the assembled state the end wall 15 is recessed relative to the end of the bearing rail 1. In the intermediate space coated by the recess, a sealing strip 55 is laid which, when joining the nodal element 2 and the bearing rail 1 together, comes to rest against the outer surface of the side wall 19 of the sealing body 8 in a sealing manner. In order to ensure that the frame shoe 38 is recessed in this manner the supporting flange 3 is provided on both sides with a stop notch 50. The sealing band 20 extends, in this case as well as in the embodiment shown in FIG. 1, from the upper side of the supporting edges 17 around the miter 14 and along the lower side of the supporting flange 3.

Figure 2B:
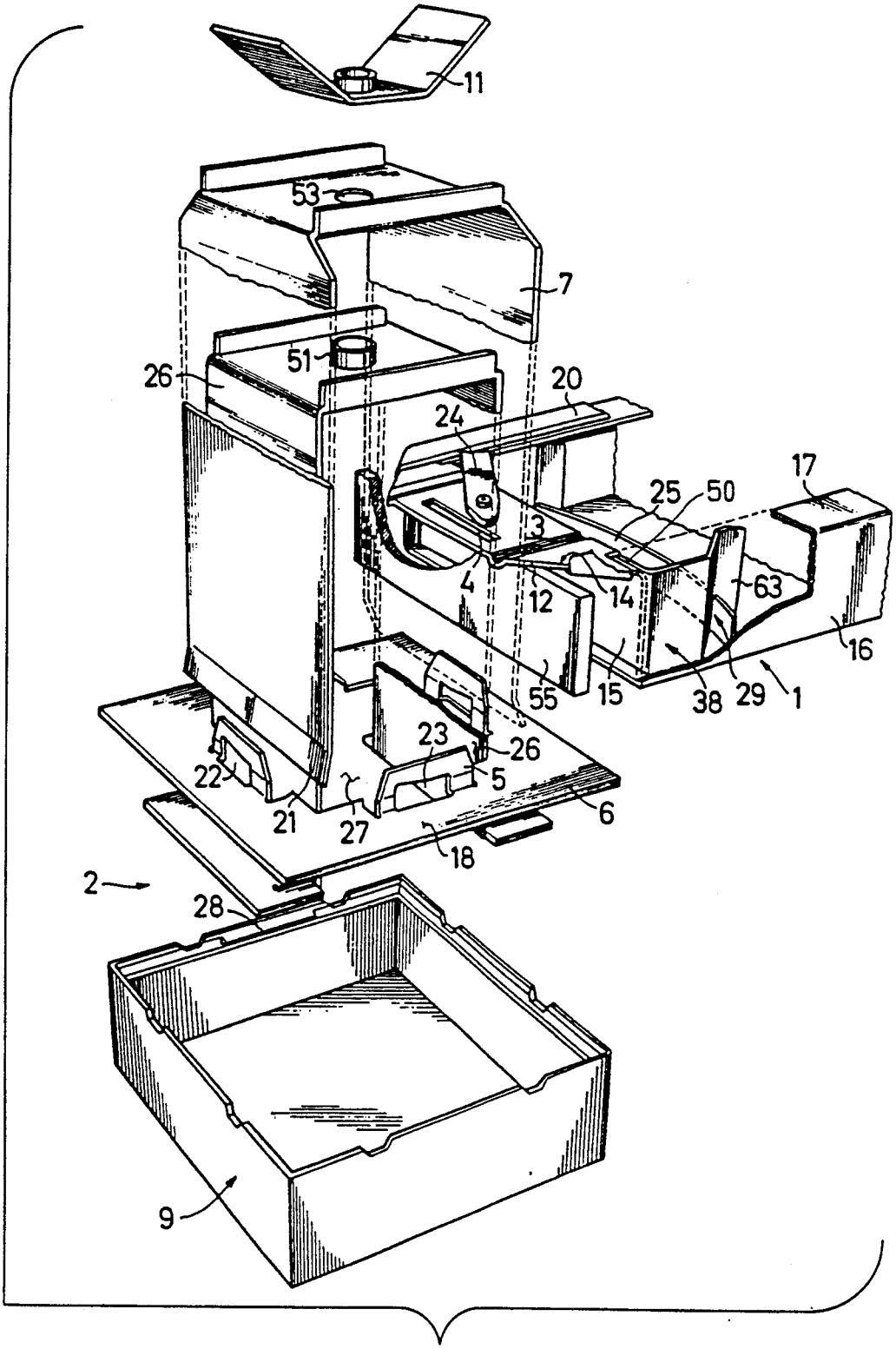
Figure 3A:
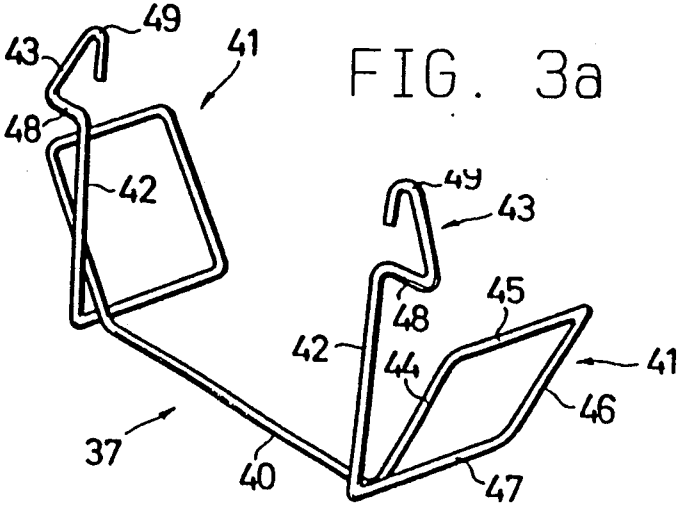
Figure 3D:
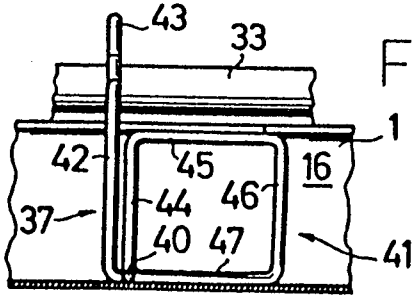
Figure 3C:
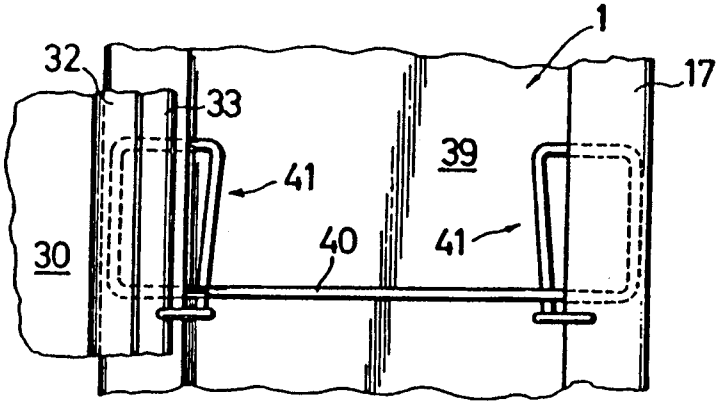
Figure 3B:
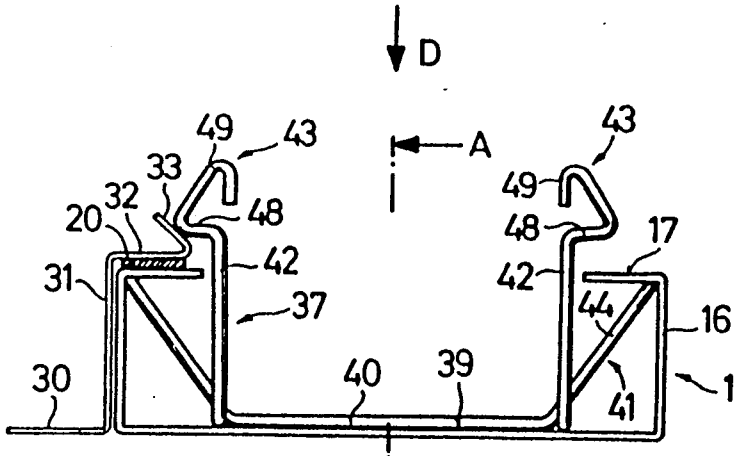

FIG. 2*b* shows another embodiment of the nodal element 2 and of the frame shoe 38. A plate shaped bearing element 6 preferably has a central cut-out 27, which is bridged by a bracket-shaped clamping element 7 and a bracket-shaped fastening element 26, which provides a space for accommodating ceiling accessories, such as sprinklers. The frame shoe 38 is held in a frictionally engaged manner between the inner sides of both longitudinal side walls 16 of the bearing rail 1 by a clamping mechanism 25. The clamping mechanism 25 is a spring which enters with its ends through the slot-shaped cut-outs 29 onto side flanges 63 of the frame shoe 38 laid in one direction.

In this embodiment, the nodal element 2 consists substantially of a plate-shaped bearing element 6, an inspection cover 9 mounted on the bearing element 6 and a bracket- shaped fastening element 26 (shown in partially dashed lines on the bearing element 6). The nodal element 2 is provided on its upper side with a nut 51 which is able to be screwed onto a threaded rod similar to FIG. 1, but which is not shown.

The bearing element 6 (shown individually in is constructed in one piece around four holding lugs 5, directed upwardly, which are provided in each case with a slot 22 to accommodate locking mechanism 24. The upper edge 23 of slot 22 has an angle that extends obliquely to a horizontal line in order to lock locking mechanism 24 in slot 22. The bearing element 6 has in the centre a cut-out 27, through which the lower flank ends of the fastening element 26 project. The clamping element 7 (shown individually in FIG. 6) is constructed in this embodiment like the fastening element 26 (shown individually in FIG. 7), in the form of a bracket. On the lower side of both flanks of clamping element 7 on its lower side is provided with clamping edge 21 which is slightly bent outwards. Clamping edge 21 is wider than the supporting flange 3 of the frame shoe 38 which is cut on a miter 14. The inspection cover 9 is provided on its inner side with locking lugs 28 which are provided for securing the inspection cover 9 to the bearing element 6. The bracket-shaped construction of clamping element 7 and the fastening element 26 overlapped by it enables the accommodation of ceiling accessories, such as sprinklers.

With the aid of a spring element 37, illustrated in FIGS. 3*a*–3*d*, the supporting edges 32 of the insert members 30, and particularly the oblique folds 33 in the fitted state of the insert members 30 are acted upon by pressure in the direction of the respective supporting edge 17 of the bearing rails 1, provided with the sealing band 20. The spring element 37 is adapted to be inserted, with elastic deformation, into the bearing rail 1 constructed as a C-profile. In its assembled position the spring element 37 has a base section 40 lying inside on the base 39 of the bearing rail 1. Connected to the base 40 are clamps 41 (locking portions), pointing obliquely outwards and upwards, which grip below the oppositely disposed supporting edges 17 of the bearing rail 1. Connected to the respective clamps 41 there is a clamping flank 42 (flank portions) extending upwardly from the base section 40, which grips the supporting edges 32 of the insert member 30 with a clamping portion angled outwards, and acts preferably on the oblique fold 33 of the insert member 30 or in a clamping manner.

The spring element 37 represented in FIGS. 3*a–d* is formed in one piece from spring wire. In this way the clamp 41 has four clamp sections 44, 45, 46, 47 bent in a rectangular shape. The first clamp section 44 and the third clamp section 46, as viewed from the base 39 of the bearing rail 1, extend obliquely upwards and outwards. The second clamp section 45, lies in the angle between the longitudinal side wall 16 and the supporting edge 17 of the bearing rail 1, and the fourth clamp section 47 lies on the base of the bearing rail 1. In this manner the spring element 37 has a fixed clamp seat in the interior of the bearing rail 1, while simultaneously the clamping flanks 42, with the clamping portion 43, exert a clamping force on the oblique fold 33 of the insert member 30 effectively and practically independently, in a freely mobile manner.

The clamping flank 42 is connected directly to the fourth clamp section 47, which, when moved sideways, is subjected to a torsional force. The clamping portion 43 has a clamping section 48 (outwardly angled projections), approximately parallel to the base 39 of the bearing rail 1, extending outwards in order to act on the oblique fold 33 of the insert member 30. A handling section 49 connected to the clamping section 48 enables both flanks 42 to be pressed together by hand and thus release the insert members 30.

The positioning of the spring element 37 is accomplished by first introducing the spring element 37 from the top into the interior of the bearing rail 1 with the base part 40, standing approximately parallel to the bearing rail longitudinal direction. Then the spring element 37 is rotated in such a way that the clamps 41 lock under the supporting edges 17 and the clamping flanks 42 project with their clamping portions 43 over the supporting edges 17 and are ready for clamping the adjacent insert members 30.

Figure 4A:
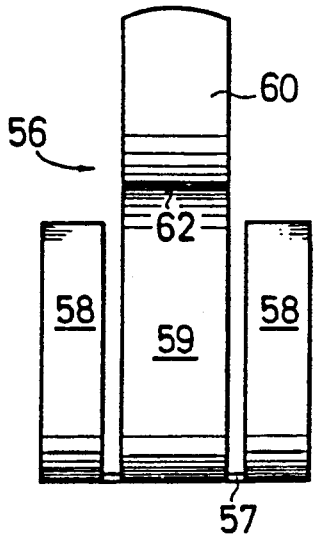
Figure 4B:
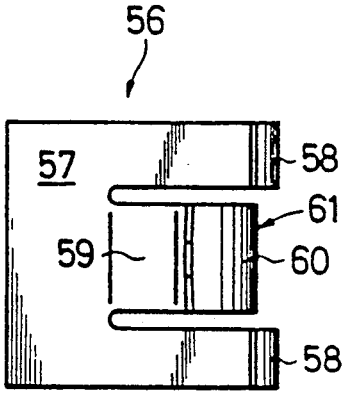
Figure 4C:
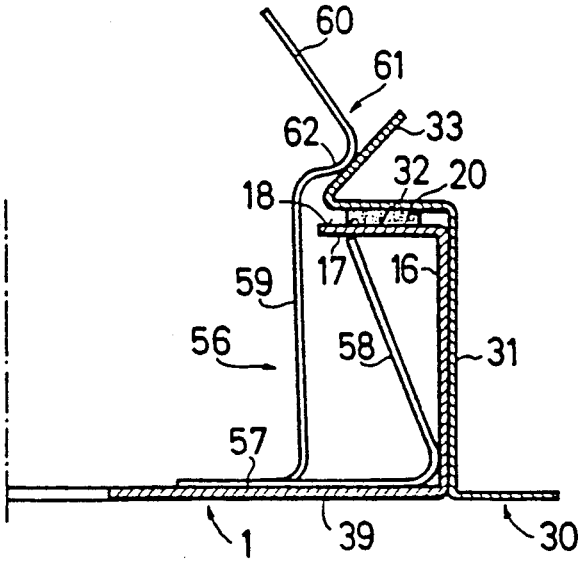

In FIGS. 4*a–c* a further embodiment of a spring element 56 is represented. The spring element 56 is inserted, with elastic deformation, into the bearing rail 1, constructed as a C-profile. In the assembled position the spring element 56 has a base section 57, lying inside on the base 39 of the bearing rail 1. Extending from the base section 57 are locking tongues 58 (locking portions), extending obliquely inwards and upwards and gripping under the oppositely disposed supporting edges 17 of the bearing rail 1. Connected to the base section 57 there is, in the center, a spring portion 59 (flank portions) extending upwards, which grip over the supporting edge 32 of the insert member 30 by means of a projection 61 angled outwards to exert a clamping force on the insert member 30.

The spring element 56 represented in FIGS. 4*a–c* is manufactured in one piece from a sheet metal strip, wherein the locking tongues 58 and the spring portion 59 extend in each case from the base section 57 upwards. In this manner the spring element 56 has a fixed clamp seat in the interior of the bearing rail 1 while at the same time the spring portion 59, with the projection 61, exerts a clamping force, in a freely mobile manner, on the oblique fold 33 of the insert member 30 effectively and practically independent thereof.

The projection 61 has a clamping section 62, approximately parallel to the base 39 of the bearing rail 1 and extending outward, acting on the oblique fold 33 of the insert member 30. A sliding section 60 connected to the clamping section 62 enables the spring portion 59 to be pressed over and thus release the insert members 30.

To use this embodiment, the spring element 56 is inserted into the C-profile of the bearing rail 1 with the area of the base section 57 transition into the locking tongues 58 abutting the inner side of the longitudinal side wall 16. The elastic locking tongues lock on the lower side of the supporting edge 17.

Referring again to FIG. 1, for assembly of the sub-ceiling according to the invention the respective tightening nuts 11 are first screwed onto the threaded rods 10. Subsequently, the clamping elements 7 and the sealing elements 52 are mounted, then the counter nuts 13 are screwed on. The bearing element 6 with the sealing body 8, or alternatively the fastening element 26 with the bearing element 6, are screwed on to the desired height on the threaded rod 10 and secured by means of the counter nuts 13. Then the bearing rails 1, already provided with sealing means 20, are suspended with the recesses 4 on the holding lugs 5 of the bearing elements 6. The clamping elements 7, by means of the tightening nuts 11, move the bearing rails 1 in the direction of the bearing faces 18 of the nodal elements 2. The sealing means 20 are thereby pressed together until the front edge of the respective supporting flanges 3 strike the edge of the bearing element 6 projecting over the bearing surfaces 18. The lower side of the bearing rails 1 form a substantially plane surface with the lower side of the inspection cover 9 placed from below on the sealing body 8 or the bearing element 6.

Next, the insert members 30 or in their place illuminating elements, air-supply devices, air-outlet devices or the like, correspondingly shaped in their outer circumference, are inserted into the open ceiling regions 34. For this purpose, canted from below, the insert members 30 are inserted through the ceiling regions 34 into the intermediate space between the ceiling and sub-ceiling, in order to be applied from the top with the supporting edges 32 on the sealing means 20 on the upper side of the supporting edges 17 of the bearing rails 1. Before this, however, the spring elements 37 or 56 can be introduced into the bearing rails 1, in order to increase the bearing pressure. The height of the side walls 31 is dimensioned in accordance with of the material thickness of the supporting edges 32 as well as the height of the bearing rails 1, including the sealing means 20, so that once the insert members 30 or other devices have been secured on the bearing rails 1 their lower sides are aligned with the lower sides of the bearing rails 1 and the inspection cover 9 of the nodal elements 2.

In the ceiling construction according to the invention obviously no sealing of the vertical joints between the bearing rails 1 and the insert members 30 is required so that this can be kept exceptionally narrow.

What is claimed is:

1. A sub-ceiling comprising:

an intersecting grid of bearing rails (1) defining open regions (34) therebetween, said rails having longitudinal side walls (16), end walls (15), angular supporting flanges (3) each defining a slot-shaped recess (4) and extending outwardly and perpendicularly from said end walls (15), means (20) for sealing provided along the bearing rails and supporting flanges (3), and means (24) for locking disposed on said supporting flanges (3);

a plurality of nodal elements (2) providing means for suspension of the sub-ceiling, said nodal elements having substantially horizontal bearing surfaces (18) on which said supporting flanges (3) rest and a lug (5) extending substantially vertically from said bearing surface and through said recess (4) in said supporting flanges (3), said lug defining a slot (22) for receiving said locking means (24); and insert members (30) resting against said sealing means (20) on bearing rails (1) to secure the open regions (34) in an air-tight and dust-tight sealed manner.

2. A suspended ceiling, comprising:

an intersecting grid of bearing rails (1) defining open regions (34) therebetween, said rails having end walls (15) with supporting flanges (3) extending outwardly and substantially completely across said end walls, wherein said flanges are provided with mitered outward corners (14) and sealing means (20) extending along an upper surface said rails and around said mitred corners;

at least one nodal element (2) for supporting bearing rails (1), said nodal elements having substantially horizontal bearing surfaces (18), wherein the supporting flanges (3) rest on said bearing surfaces (18) to support said rails with said sealing means (20) lying between said bearing surfaces and said flanges and lying between adjacent flanges (3) to seal along said mitred corners (14) whereby gaps between said corners, flanges and bearing surfaces are sealed in an air-tight and dust-tight manner; and insert elements (30) resting on said sealing means (20) along the upper surface of the bearing rails to seal the open regions also in an air-tight and dust-tight manner.

3. A suspended ceiling comprising an intersecting grid of elongate carrier beams (1) defining open regions (34) therebetween, said carrier beams (1) being suspendable from nodal elements (2) having substantially horizontal support surfaces (18) to receive supporting flanges (3) extending from longitudinal end walls (15) of said carrier beams (1) and insert elements (30) for accommodation within said open regions (34) wherein the supporting flanges (3) of adjacent carrier members (1) are each provided with complementary miter edges (12; 14) and wherein there is provided a sealing means (20) along the carrier beams (1) upon which said insert elements (30) rest as well as between the supporting flanges (3) of the carrier beams (1) and the support surfaces (18) of said nodal elements (2), which sealing means (20) also extend over the miter edges (12; 14) of said supporting flanges (3) to seal off any gaps remaining between adjacent miter edges in an air-tight and dust-tight manner.

4. A sub-ceiling according to claim 2 or 3, wherein the insert-member (3) is selected from a group consisting of solid coffer-shaped panels, lighting elements, air supply device and air outlet devices.

5. A sub-ceiling according to claim 2 or 3, characterized in that the bearing rails (1) have two parallel longitudinal side walls (16) with upper edges and angular supporting edges (17) disposed along said upper edges for sealed accommodation of the insert member (30).

6. A sub-ceiling according to claim 5 characterized in that the angular supporting edges (17) of each bearing rail (1) are directed inwardly towards each other, and the sealing means (20) is provided on an upper surface of the supporting edges (17), wherein the sealing means (20) pass through from the upper surface of the supporting edges (17) to the lower side of the supporting flanges (3).

7. A sub-ceiling as in claim 6, wherein the sealing means (20) comprises a continuous sealing band.

8. A sub-ceiling according to claim 7, characterized in that the supporting flanges (3) are connected to adjoining ends of the supporting edges (17) and the sealing means (20) on each bearing rail (1) is constructed as a band in one piece extending over the miter cuts, and thereby sealing the miter joint (14).

9. A sub-ceiling according to claim 2 or 3, characterized in that the nodal elements (2) are provided with substantially vertical holding lugs (5), and further in that the supporting flange (3) of at least one of the bearing rails (1), cooperating with a nodal element (2), is provided with a slot-shaped recess (4), in which the vertical holding lugs (5) of the nodal elements (2) engage.

10. A sub-ceiling according to claim 9, characterized in that each holding lug (5) has a slot (22) for accommodating a locking mechanism (24).

11. A sub-ceiling according to claim 10, characterized in that the slot (22) has an upper edge (23) that extends obliquely to a horizontal line and the locking mechanism (24) is able to be locked in a horizontal line in the slot (22).

12. A sub-ceiling according to claim 2 or 3, characterized in that each nodal element (2) is provided with a clamping element (7) for biasing the bearing rails (1), intersecting at the nodal elements (2), in a sealing manner against the nodal elements (2), said clamping element (7) acts on the supporting flanges (3) of the bearing rails (1) to provide said biasing and the means for biasing said clamping element (7) is a tightening nut (11) forcing the clamping element (7) against the nodal element (2) and or the supporting flanges (3) of the bearing rails (1).

13. A sub-ceiling according to claim 2 or 3, characterized in that the bearing surfaces (18) of the nodal element (2) are part of a sealing body (8), having an inspection cover (9) capable of being placed thereupon.

14. A sub-ceiling according to claim 13, characterized in that the sealing body (8) defines a central cut-out (27), which is clamped over by at least one of a bracket-shaped clamping element (7) and a bracket-shaped fastening element (26), to further define a space for accommodating ceiling accessories 15. A sub-ceiling according to claim 2 or 3, characterized in that the bearing rails (1) are cut off in fixed lengths to form two open ends and further in that a frame shoe (38), having a Z-fold forming the end wall (15) and the extending supporting flange (3), is inserted into end of the bearing rails (1).

16. A sub-ceiling according to claim 15, characterized in that the frame shoe (38) has at least one slot-shaped cut-out (29) cooperating with a spring-flexible clamping mechanism (25) locking the frame shoe (38) relative to the bearing rail (1).

17. A sub-ceiling according to claim 16, characterized in that the frame shoe (38) is provided with a stop notch (50) restricting the insertion depth of the frame shoe (38) into the bearing rail (1) and in that the end wall (15)

and the side wall (19) of the nodal element (2) define therebetween a space provided for a sealing strip (55).

18. A sub-ceiling according to claim 2 or 3, characterized in that the insert members (30) are provided with vertical side walls (31) having upper ends with circular supporting edges (32), angled horizontally outwards and continuous all around said insert member (30) and further provided with reinforcement folds (33), directed obliquely upwards at an angle of about 45° relative to the supporting edges (32).

19. A sub-ceiling according to claim 18, characterized in that the oblique reinforcement folds (33) of the supporting edges (32) of the insert members (30) are biased in place by a spring element (37, 56), said spring element (37, 56) provided with a substantially horizontal base portion (40, 57) having upwardly angled and extending locking portions (41, 58) cooperating with the supporting edge (17) and a substantially vertical, upwardly extending flank portion (42, 59) and further in that said spring element (37, 56) is inserted into the bearing rails (1), with elastic deformation of the locking portions (41, 58).

20. A sub-ceiling according to claim 19, characterized in that the flank portion (42, 59) of the spring element (37, 56) is provided with an outwardly angled projection (48, 61) biasing the oblique reinforcement folds (33) of the insert members (30) against the sealing means (20) of the bearing rails (1).

* * * * *